US006244176B1

(12) United States Patent
Sonobe et al.

(10) Patent No.: US 6,244,176 B1
(45) Date of Patent: Jun. 12, 2001

(54) PRINTING APPARATUS FOR PRINTING ON A MEDIUM BY TRANSFERRING A PLURALITY OF DIFFERENT COLOR INKS ONTO AN ELASTIC ENDLESS BLANKET

(75) Inventors: Saburo Sonobe, Toride; Akio Onuki, Ibaraki, both of (JP)

(73) Assignee: Kinyosha Co., Ltd., Tokyo (JP)

( * ) Notice: Subject to any disclaimer, the term of this patent is extended or adjusted under 35 U.S.C. 154(b) by 0 days.

(21) Appl. No.: 09/382,227

(22) Filed: Aug. 24, 1999

(30) Foreign Application Priority Data

Aug. 28, 1998 (JP) ..... 10-243058

(51) Int. Cl.[7] ..... B41J 16/00
(52) U.S. Cl. ..... 101/217; 101/177; 101/178
(58) Field of Search ..... 101/136, 138, 101/139, 140, 137, 143, 144, 177, 178, 181, 184, 218, 182, 183, 217

(56) References Cited

U.S. PATENT DOCUMENTS

| | | | | |
|---|---|---|---|---|
| 2,718,847 | * | 9/1955 | Jackson et al. | 101/177 |
| 3,263,606 | * | 8/1966 | Poynter | 101/179 |
| 4,770,928 | | 9/1988 | Gaworowski et al. | 428/284 |
| 4,812,357 | | 3/1989 | O'Rell et al. | 428/246 |
| 5,456,171 | * | 10/1995 | Biava et al. | 101/122 |
| 5,478,637 | * | 12/1995 | Tomono et al. | 428/246 |

FOREIGN PATENT DOCUMENTS

| | | | | |
|---|---|---|---|---|
| 2435251 | * | 2/1976 | (DE) | 101/177 |
| 39 01 176 A1 | | 8/1989 | (DE) . | |
| 92 18 764 U | | 5/1992 | (DE) . | |
| 693 14 987 T2 | | 5/1998 | (DE) . | |
| 893855 | * | 11/1944 | (FR) | 101/177 |

OTHER PUBLICATIONS

Office Action in German Patent Application No. 199 40 388.0–27 dated Oct. 27, 2000 (with translation).

* cited by examiner

*Primary Examiner*—Daniel J. Colilla
(74) *Attorney, Agent, or Firm*—Lackenbach Siegel Marzullo Aronson & Greenspan

(57) ABSTRACT

Disclosed is a printing apparatus comprising a driving roll, a supporting roll, an endless offset blanket stretched between the driving roll and the supporting roll, a plurality of plate cylinders for transferring inks having a plurality of different colors onto the endless offset blanket, a plurality of first impression drums arranged to have the endless offset blanket held between the first impression drums and the plate cylinders, ink supply means for supplying the inks of the plural colors to the plate cylinders, and a second impression drum positioned to push the supporting roll and to have a printing medium held between the supporting roll and the second impression drum, the inks of the plural colors transferred onto the endless offset blanket being printed on the printing medium in a single operation.

8 Claims, 3 Drawing Sheets

PRINTING APPARATUS FOR PRINTING ON A MEDIUM BY TRANSFERRING A PLURALITY OF DIFFERENT COLOR INKS ONTO AN ELASTIC ENDLESS BLANKET

BACKGROUND OF THE INVENTION

The present invention relates to a printing apparatus for continuously printing a seamless continuous pattern on wall paper, corrugated cardboard, color wrapping paper, face steel plate, etc.

The conventional offset printing is performed by rotating in mutual contact a plate cylinder, a blanket cylinder and an impression drum. FIG. 1 shows a concept of sheet-fed offset printing machine. As shown in the drawing, the offset printing machine includes a plate cylinder 1, a blanket cylinder 2 and an impression cylinder 5. The plate cylinder 1 is formed of an aluminum cylinder having a thin aluminum sheet wound thereon as a printing plate. A photosensitive resin layer having a compatibility with an ink is formed on the thin aluminum sheet. A rubber blanket sheet (not shown) is attached to the blanket cylinder 2 by a metal fitting bar. An oil-resisting surface rubber layer for performing an ink transfer is formed on the rubber blanket sheet.

A groove 3 is formed on each of the plate cylinder 1 and the blanket cylinder 2, with the result that a blank portion in which the printing is not performed is formed on a printing medium 4 such as a paper sheet. The impression drum 5 serves to transfer in a predetermined direction the printing medium 4 held between the blanket cylinder 2 and the impression cylinder 5. An ink is supplied from an inking device 6 consisting of a plurality of rolls 6*a*, 6*b*, 6*c*, 6*d*, 6*e* and 6*f* onto the plate cylinder 1.

The rubber blanket for the conventional offset printing machine is prepared in a length of several hundred meters and, when used, the long rubber blanket is cut to meet a required machine size. In general, the rubber blanket is prepared by bonding 2 to 4 woven fabric sheets with a rubber paste, and the surface rubber layer is heated in a vulcanizer for the vulcanization. Then, the surface rubber layer is polished to have a required thickness, thickness uniformity and surface roughness.

FIG. 2 exemplifies an offset rotary press including a plurality of units. Each unit comprises a pair of blanket cylinders 12 having a web paper 14 held therebetween, plate cylinders 11 positioned in contact with the blanket cylinders 12, inking devices 13 for supplying an ink to these plate cylinders 11, and dampening units 15. Printing can be performed on both side of the web paper 14 simultaneously. If the paper sheet 14 is passed through four units continuously, four color printing can be performed on both surfaces of the paper sheet 14. The particular offset rotary press is widely used for the printing of news paper advertising paper sheets, etc.

A printing plate and a rubber blanket are mounted in the form of a sheet to each of the plate cylinders and the blanket cylinders in the case of the offset rotary press, too, with the result that a blank portion in which the printing is not performed is formed in a width of about 10 mm. Also, the thickness of the printing paper sheet used is limited to about 0.1 mm or less, making it impossible to carry out the printing on a corrugated cardboard or a steel plate.

FIG. 3 shows a concept of a flexographic press. The flexographic press comprises mainly an ink pan 21 housing an ink, a rubber roll 22 having a part thereof dipped in the ink housed in the ink pan 21, an anilox roller 23 having fine cells formed on the surface, a doctor blade 24 for removing an excess ink, an plate cylinder 26 positioned adjacent to the anilox roller 23 and having a flexographic printing plate 25 formed on the surface, and an impression cylinder 28. A printing medium 27 such as a corrugated cardboard or a plastic film is held between the plate cylinder 26 and the impression cylinder 28.

In the flexographic press, an ink is supplied from the rubber roll 22 to the anilox roller 23, and an excess ink is removed by the doctor blade 24 such that a required amount of the ink is supplied to the flexographic printing plate 25. Further, the ink is transferred from the flexographic printing plate 25 onto the printing medium 27 so as to finish the printing operation. In the flexographic printing, the printing plate is prepared by forming a manual or laser engraving on a soft and elastic material such as a rubber plate or a photosensitive resin plate. However, the flexographic printing is far inferior in the printed image quality to the offset printing.

The printing plate for the offset printing is prepared by coating an aluminum plate with a lipophilic (compatible with ink) photosensitive resin, followed by exposing the photosensitive resin layer to light through a negative film so as to fuse the non-image portion. As a result, the non-image portion is exposed to the outside so as to be made hydrophilic. The most excellent image quality can be obtained by the offset printing among the various printing techniques available nowadays partly because the image quality is determined by the magnitude and area ratio of the dot and partly because the ink is transferred to the printing medium such as a paper sheet through a rubber blanket. In the offset printing, the rubber blanket is said to be the most important factor for determining the quality of the printed image.

Recently, a blanket in which a porous rubber layer is interposed as a compressible layer between adjacent woven fabric sheets is mainly used in the printing field. The entire thickness of the blanket generally falls within a range of between 1 mm and 2 mm, and the actual thickness is determined to meet the specification of the printing machine.

In the ordinary offset printing machine, the printing is performed successively with inks of four colors, i.e., black, cyan, magenta and yellow, by four units so as to obtain a colored print. In the conventional offset printing machine, however, a groove is formed in each of the plate cylinder and the blanket cylinder for attaching a sheet-like printing plate and blanket to these cylinders. It follows that the size of the print is limited. For example, it is impossible to print a continuous pattern on a large and thick printing medium such as a wall paper sheet wrapping paper or a face steel plate.

BRIEF SUMMARY OF THE INVENTION

An object of the present invention, which has been achieved as a result of an extensive research made in an attempt to overcome the above-noted difficulties inherent in the conventional offset printing, is to provide a printing apparatus which permits printing a continuous pattern on a large and thick printing medium by transferring in a superposed fashion images of multi-colors onto the same blanket so as to achieve printing on the printing medium in a single operation.

According to one embodiment of the present invention, there is provided a printing apparatus comprising a driving roll, a supporting roll, an endless offset blanket stretched between the driving roll and the supporting roll, a plurality of plate cylinders for transferring inks having a plurality of different colors onto the endless offset blanket, a plurality of first impression drums arranged to have the endless offset blanket held between the first impression drums and the plate cylinders, ink supply means for supplying the inks of the plural colors to the plate cylinders, and a second impression drum positioned to push the supporting roll and to have a printing medium held between the supporting roll and the second impression drum, the inks of the plural colors transferred onto the endless offset blanket being printed on the printing medium in a single operation.

In the present invention, a continuous pattern can be printed on a large and thick printing material by transferring images consisting of a plurality of different colors onto the same blanket.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
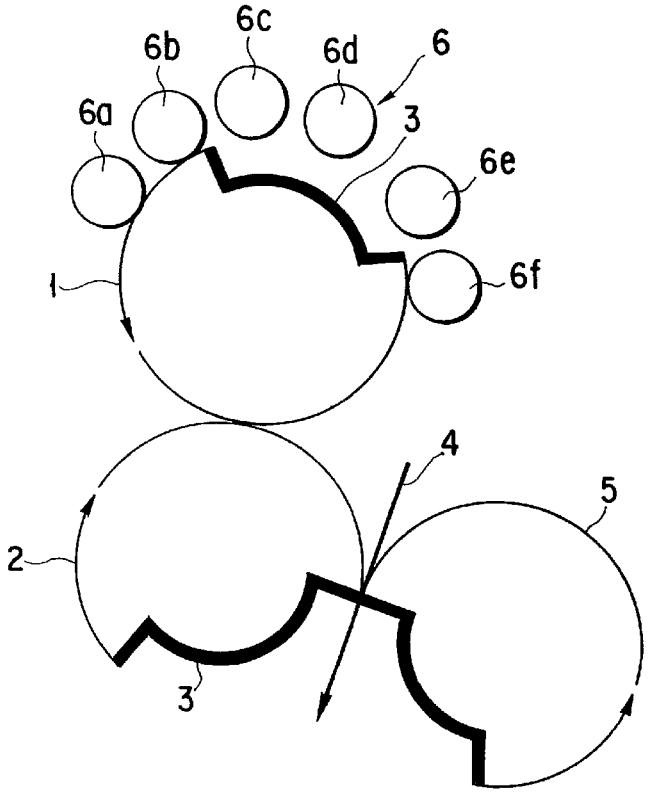
FIG.1 PRIOR ART
FIG. 1 shows a concept of a sheet-fed offset printing machine.
Figure 2:
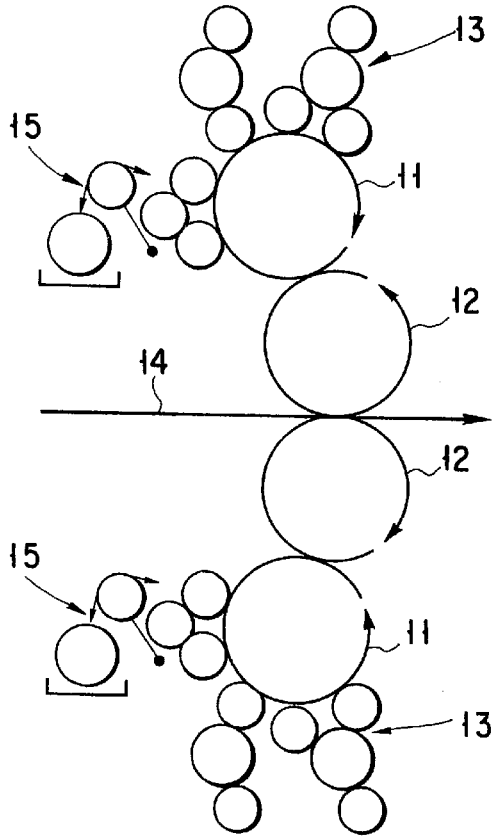
FIG.2 PRIOR ART
FIG. 2 shows a concept of an offset rotary press.
Figure 3:
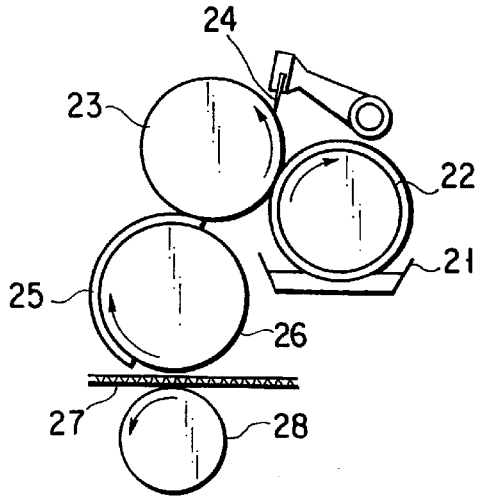
FIG. 3 PRIOR ART
FIG. 3 shows a concept of a flexographic printing machine.

A printing apparatus according to one embodiment of the present invention comprises an endless offset blanket. The blanket includes a reinforcing layer consisting of a single string layer or a plurality of string layers, a compressible rubber layer formed on the reinforcing layer, and an ink-resisting surface rubber layer formed on the compressible rubber layer. It is desirable for the blanket to exhibit an elongation of at most 5% under a tension of 5 kgf/cm. If the elongation is more than 5%, the reproducibility of the image is lowered.

The string used for forming the reinforcing layer is selected from the group consisting of natural fibers such as cotton fiber, hemp fiber, silk fiber and rayon fiber; synthetic fibers such as polyester fiber, nylon fiber, polyamide fiber, polyimide fiber, Aramid fiber, and polyacrylate fiber; inorganic fibers such as glass fiber, boron fiber, tyrano fiber, alumina fiber, steel fiber and ceramic fiber; and carbon fiber. The string may be in the form of either a single-ply monofilament or a two-ply monofilament.

The thickness of the string, which depends on the material of the string and the thickness of the blanket, should desirably be 0.1 to 0.5 mm. The distance between adjacent turns of the string forming the reinforcing layer should desirably be determined to permit the adjacent turns of the string layer to be brought into mutual contact. If the distance between adjacent turns of the string is unduly large, the string pattern appears on the printing paper. In addition, the reinforcing layer fails to exhibit a sufficient mechanical strength.

The material of the compressible rubber layer and the surface rubber layer should be selected from the group consisting of acrylonitrile rubber, butadiene rubber, hydrogenated nitrile rubber, chloroprene rubber, silicone rubber, fluorosilicone rubber, epichlorohydrin rubber, natural rubber, butyl rubber, fluororubber, ethylene-propylene rubber, isoprene rubber, urethane rubber, styrene-butadiene rubber, and a mixture thereof. The same or different materials can be used for forming the compressible rubber layer and the surface rubber layer.

In the printing apparatus of the present invention, an endless offset blanket is stretched between a supporting roll and a driving roll. Also, a plurality of plate cylinders and a plurality of impression drums are arranged between the supporting roll and the driving roll such that the endless offset blanket is held between these plate cylinders and impression cylinders. The plate cylinder is provided with an inking apparatus including ink rolls. For example, four pairs of the plate cylinder and the impression cylinder are used in the printing apparatus of the present invention. Inks of black, cyan, magenta and yellow are supplied to the four cylinder plates so as to be transferred onto the endless offset blanket which is pressed by the four impression cylinders, respectively. Finally, the colored ink image supported by the endless offset blanket is transferred onto a printing medium such as a paper sheet.

Let us describe a printing apparatus according to one embodiment of the present invention with reference to the accompanying drawings.

Figure 4:
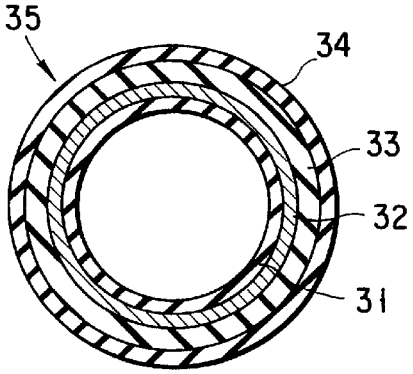
FIG. 4 is a cross sectional view showing an endless offset blanket used in the printing apparatus of the present invention.

FIG. 4 is a cross sectional view showing an endless offset blanket 35 included in the printing apparatus of the present invention. As shown in the drawing, the blanket 35 comprises an inner rubber layer 31, a reinforcing layer 32 formed on the outer surface of the inner rubber layer 31 and consisting of a continuous string, a compressible rubber layer 33 formed on the outer surface of the reinforcing layer 32, and an ink-resisting surface rubber layer 34 formed on the outer surface of the compressible rubber layer 33. The blanket 35 is rotated during the printing operation and deformed during the rotation. It should be noted in this connection that, originally, rubber is not compressible. If the compressible rubber layer 33 is not included in the blanket 35, the rolling length of the surface of the blanket 35 per rotation is increased, leading to poor reproduction of the printing plate. Particularly, where the deformation amount (printing pressure) is large, a so-called "circumferential increase rate" is increased.

The compressible rubber layer 33 is formed by any of methods (1) to (3) given below:

(1) A foaming agent is added to rubber and foamed under heat to prepare a sponge rubber.

(2) A powdery material soluble in a water, e.g., fine powder of sodium chloride, is added to rubber and, after vulcanization, a powdery material is extracted with warm water.

(3) Thermoplastic microballoons are added to rubber, and the rubber is vulcanized so as to embed the microballoons in the rubber.

The compressibility of the compressible rubber layer is determined substantially by the porosity of the porous rubber. The porosity of the compressible rubber layer should desirably be about 50% in view of the circumferential increase rate.

The surface rubber layer 34 is selected in view of the compatibility with ink and the ink receiving and transferring capability. In the case of using an ordinary ink containing a petroleum series vehicle, it is desirable to use acrylonitrile-butadiene rubber (nitrile rubber) and urethane rubber because these rubbers are low in swelling. Ultraviolet curing ink (UV ink) contains an acryl ester type monomer or oligomer as a vehicle. Also, benzoquinone, etc. is used as a photo polymerization in the UV ink. Therefore, it is desirable to use ethylene-propylene rubber, butyl rubber and fluororubber for forming the surface rubber layer 34 in the case of using an UV ink.

In the case of an on-demand digital printing machine utilizing an electrophotographic system, images are formed first on a photosensitive drum and, then, electrically transferred onto a rubber blanket for printing on a printing medium such as a paper sheet. In this system, 100% of the image on the rubber blanket must be transferred onto the printing medium. Therefore, it is desirable to use a material having good mold release characteristics such as silicone rubber, fluorosilicone rubber and fluorine-containing rubber for forming the surface rubber layer 34.

In the electrophotographic system, a semiconductivity must be imparted to the compressible rubber layer 33 by adding an conductive material such as carbon black to the rubber. Also, the surface rubber layer 34 directly affects the image reproducibility on the printed material, making it necessary to decrease the surface roughness. It is also necessary to control accurately the thickness of the surface rubber layer 34. It follows that the surface rubber layer 34 must be polished with a fine sand paper or whetstone.

The elastic endless offset blanket 35 included in the printing apparatus of the present invention is manufactured as follows.

Figure 5:
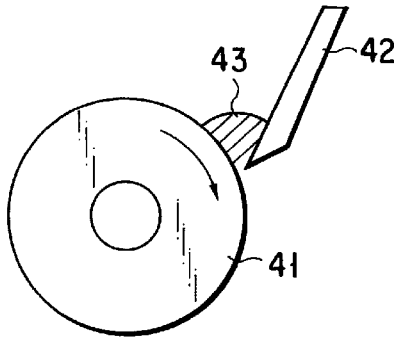
FIG. 5 shows how a mandrel is coated with a rubber paste.
Figure 7A:
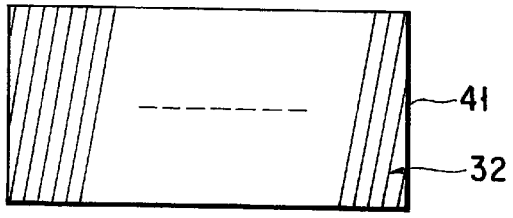
FIG. 7A shows a reinforcing layer consisting of a single string layer.
Figure 7B:
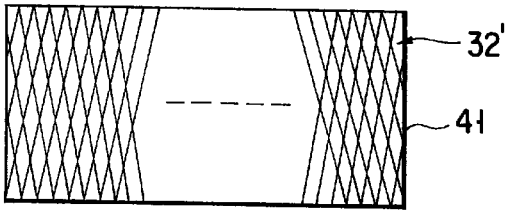
FIG. 7B shows a reinforcing layer consisting of a plurality of string layers.

(1) As shown in FIG. 5, a mandrel 41 having a desired outer diameter and length is prepared in the first step. Then, the mandrel 41 is mounted to a rotating carriage, and a doctor blade 42 is positioned in the vicinity of the mandrel 41. Under this condition, a rubber paste 43 is supplied in the clearance between the outer surface of the mandrel 41 and the tip portion of the doctor blade 42, and the mandrel 41 is rotated so as to form the inner rubber layer 31 as shown in FIG. 4. Then, a bobbin 44 wound with a string 45 is arranged in front of the mandrel 41 having the inner rubber layer 31 formed thereon. The string 45 is fixed to one end of the mandrel 41, and the bobbin 44 is moved in one direction while rotating the mandrel 41. As a result, the mandrel 41 having the inner rubber layer 31 formed thereon is continuously wound with the string 45 so as to form the reinforcing layer 32 serving to prevent elongation as shown in FIG. 7A. If the bobbin 44 is moved in the opposite direction when the reinforcing layer 32 consisting of the string 45 has reached the other end of the mandrel 41, a reinforcing layer 32' is formed on the reinforcing layer 32, as shown in FIG. 7B. Where the reinforcing layer consists of double string layers, zigzag running of the endless offset blanket 35 is suppressed during the printing operation.

(2) The reason for forming the reinforcing layer 32 consisting of a continuous string is as follows. Where an endless offset blanket which does not include a reinforcing layer is formed by extrusion, the blanket is easily elongated during the printing operation, leading to a very poor image reproducibility. As a matter of fact, it is practically impossible to use such a blanket because a permanent elongation is generated in the blanket during the printing operation.

(3) Then, the compressible rubber layer 33 is formed on the outer surface of the reinforcing layer 32. In forming the compressible rubber layer 33, the rubber paste 43 prepared by adding 10 parts by weight of, for example, Expancel 091DE (which is a trade name of microballoons manufactured by Kema Novel Inc.) to a rubber paste is supplied to the clearance between the outer surface of the mandrel 41 having the reinforcing layer 32 formed thereon and the doctor blade 42. Under this condition, the mandrel 41 is rotated so as to form the compressible rubber layer 43 in a thickness of about 0.5 mm. Then, the mandrel 41 is detached from the rotating carriage, and the compressible rubber layer 43 is vulcanized in a vulcanizer under a hot air of 130° C., followed by polishing the surface of the compressible rubber layer 43 to have a desired dimensional accuracy.

(4) In the next step, the mandrel 41 is mounted again to the rotating carriage, followed by forming the surface rubber layer 34 by rotating the mandrel 41 while supplying a rubber paste to the clearance between the outer surface of the compressible rubber layer 33 and the tip portion of the doctor blade 42. The surface rubber layer 34 thus formed is vulcanized in a vulcanizer under a hot air of 130° C., followed by polishing the surface of the surface rubber layer 34 with a whetstone and, then, with a sand paper to have a surface roughness of about 4 $\mu$m. Finally, the elastic endless offset blanket 35 consisting of the surface rubber layer 34, the compressible rubber layer 33, the reinforcing layer 32 and the inner rubber layer 31 is detached from the mandrel 41.

Figure 8:
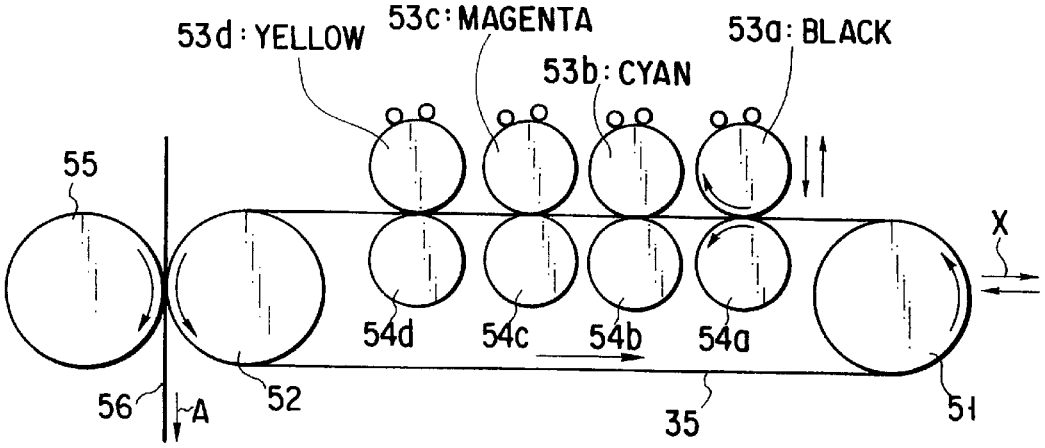
FIG. 8 shows a printing apparatus according to one embodiment of the present invention.

FIG. 8 exemplifies the printing apparatus of the present invention. As shown in the drawing, the elastic endless offset blanket 35 is stretched between a driving roll 51 and a supporting roll 52. The driving roll 51 can be moved in a horizontal direction as denoted by arrows X. When the elastic endless blanket 35 is mounted to the rolls 51 and 52, the driving roll 51 is moved to the left in the drawing. Also, tension can be imparted to the blanket 35 by moving the driving roll 51 to the right in the drawing. A plurality of plate cylinders 53*a*, 53*b*, 53*d*, 54*d* are arranged in contact with the surface rubber layer 34 of the blanket 35 in the order mentioned as viewed from the driving roll 51. Also, first impression cylinders 54*a*, 54*b*, 54*c*, 54*d* are arranged to face the plate cylinders 53*a*, 53*b*, 53*c*, 54*d*, respectively, with the blanket 35 interposed therebetween. A second impression drum 55 is arranged to face the supporting roll 52 with a printing paper sheet 56 interposed therebetween. The printing paper sheet 56 is transferred in a direction denoted by an arrow A in accordance with rotation of the supporting roll 52 and the second impression drum 55. An ink supply device (not shown) and a wetting device (not shown) are arranged in the vicinity of each of the plate cylinders 53*a* to 53*d*. The printing apparatus shown in FIG. 8 is provided with four plate cylinders. However, it is also possible to use more than four plate cylinders in the printing apparatus of the present invention.

In operating the printing apparatus of the construction described above, a driving apparatus (not shown) is operated to push the first plate cylinder 53*a* against the surface rubber layer 34 of the endless offset blanket 35, with the first impression drum 54*a* pressed against the inner surface of the blanket 35, to permit an ink of a first color, e.g., black, to be transferred into the blanket 35. Then, the second plate cylinder 53*b* is pushed against the surface rubber layer 34 of the blanket 35, with the second impression drum 54*b* pressed against the inner surface of the blanket 35, to permit an ink of a second color, e.g., cyan, to be transferred onto the first image formed by the black ink on the endless offset blanket 35. Further, the third and fourth plate cylinders 53*c*, 53*d* are successively pushed against the surface rubber layer 34 of the blanket 35, with the second and third impression cylinder 54*c*, 43*d* pressed against the inner surface of the blanket 35, to permit inks of third and fourth colors, e.g., magenta and yellow, to be transferred onto the image formed by the black and cyan inks so as to form a multi-color image on the endless offset blanket 35. Incidentally, the same colored image can be formed continuously by making the plate cylinders 53*a* to 53*d* equal to each in the circumferential length.

The elastic endless offset blanket 35 bearing the colored image is transferred through a clearance between the second impression drum 55 and the supporting roll 52. Also, the printing paper sheet 56 is continuously passed through a clearance between the second impression drum 55 and the blanket 35 so as to transfer the colored image on the blanket 35 onto the printing paper sheet 56. It follows that the colored image consisting of the inks of four colors is continuously formed on the printing paper sheet 56. Then, the inks are cured by an ink drying device (not shown) so as to finish the printing operation.

In the case of using an UV ink, the ink is irradiated with light emitted from an UV lamp so as to polymerize and cure the ink. In the case of using an oily ink, the ink is cured by a hot air.

Where the plate cylinder is formed of a water-less printing plate, i.e., a plain printing plate, in which the non-image area consists of a silicone rubber layer repelling inks, not a hydrophilic aluminum, the wetting device is not required. Further, the printing plate can be prepared in the printing apparatus by incorporating in the printing apparatus a device in which a water-less printing plate is irradiated with a laser light so as to destruct the resin layer compatible with ink and, thus, to form a non-image portion.

The plate cylinder can be prepared by, for example, extruding aluminum in a cylindrical form, followed by forming a photosensitive resin layer compatible with an ink on the surface of the extruded aluminum cylinder. Alternatively, the plate cylinder can be prepared by extruding a molten polyester resin in a cylindrical form, followed by forming an aluminum layer on the surface of the extruded polyester resin cylinder by vapor deposition and subsequently forming a photosensitive resin layer on the aluminum layer.

In the case of employing an electrophotography, a photosensitive drum is used in place of the plate cylinder and an electrical developing means is arranged in the vicinity of the photosensitive drum. Further, an endless offset blanket used consists of a compressible layer having a semi-conductivity and a surface rubber layer made of silicone rubber. Transfer of liquid toner from the photosensitive drum to the endless offset blanket is performed by an electric means.

Figure 6:
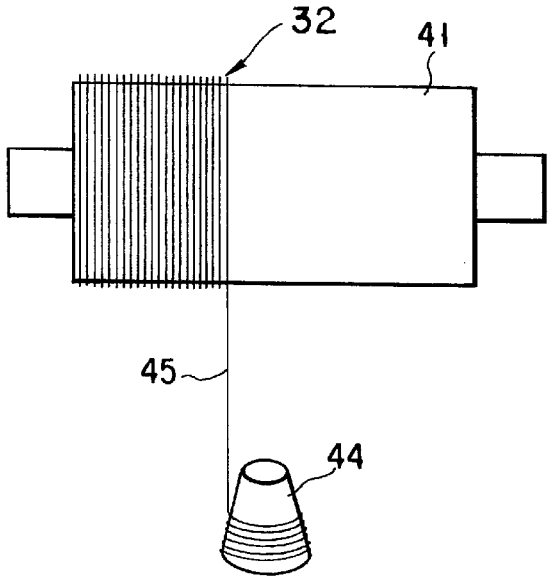
FIG. 6 shows how a string is wound about the mandrel to form a reinforcing layer.

Let us describe Examples of the present invention with reference to FIGS. 4, 5 and 6.

Example 1

A mandrel 41 having a diameter of 300 mm and a width of 350 mm was mounted to a rotating carriage, and a doctor blade 42 was arranged such that the tip portion of the doctor blade 42 was positioned in the vicinity of the outer surface of the mandrel 41, as shown in FIG. 5. Then, a rubber paste prepared by dissolving a compound shown in Table 1 in toluene was supplied in the clearance between the outer surface of the mandrel 41 and the tip portion of the doctor blade 42. Under this condition, the mandrel 41 was rotated in a direction denoted by an arrow in FIG. 5 to form an inner rubber layer 31 in a thickness of 0.5 mm. The compound shown in Table 1 is nitrile rubber having a Shore A hardness of 70° and excellent in wear resistance. Then, a bobbin 44 provided with a moving means and wound with a two-ply cotton string 45 having a thickness of 0.5 mm was arranged in front of the rotating carriage, with one end of the cotton string 45 fixed to one end of the mandrel 41.

The mandrel 41 having the inner rubber layer 31 formed thereon was rotated while moving the bobbin 44 in one direction so as to wind continuously the string 45 about the mandrel 41 in a manner to form a reinforcing layer 32 consisting of a string layer. The string 45 wound about the mandrel 41 was found to have been buried in the inner rubber layer 31. The diameter of the mandrel 41 including the inner rubber layer 31 was found to be 301.6 mm. The distance between adjacent turns of the string layer was set at 0.05 mm.

In the next step, the doctor blade 42 was arranged in the vicinity of the mandrel 41, and a rubber paste prepared by dissolving the compound shown in Table 2 in toluene was supplied to the clearance between the outer surface of the mandrel 41 and the tip portion of the doctor blade 42. Under this condition, the mandrel 41 was rotated in the direction denoted by the arrow in FIG. 5 so as to form a compressible rubber layer 33 on the reinforcing layer 32 in a thickness of 0.5 mm. The compound shown in Table 2 contains microballoons (EXPANCEL 091DE) to form a compressible rubber layer having a porosity of about 50%.

Then, the mandrel 41 was detached from the rotating carriage and put in a vulcanizer set at 130° C. so as to carry out a vulcanizing treatment for 5 hours. After the vulcanizing treatment, the mandrel was cooled and, then, the surface of the compressible rubber layer 33 was polished with a whetstone until the diameter of the mandrel 41 including the inner rubber layer 31, the reinforcing layer 32 and the compressible rubber layer 33 was decreased to 302.8 mm.

Further, rubber of the composition shown in Table 3 was sufficiently mixed and, then, formed into a sheet having a thickness of 0.5 mm by a calender machine. The resultant sheet was wound in a single ply about the surface of the compressible rubber layer 33 to form a surface rubber layer 34, followed by applying a heat treatment to the surface rubber layer 34 in a vulcanizer set at 130° C. for 3 hours.

After the vulcanizing treatment, the surface rubber layer 34 was cooled and, then, polished with a whetstone and sand paper to decrease the diameter of mandrel 41 including the inner rubber layer 31, the reinforcing layer 32, the compressible rubber layer 33 and the surface rubber layer 34 to 303.4 mm. Also, the surface roughness Rz of the surface rubber layer 34 after the polishing treatment was found to be 4 to 6 $\mu$m. Finally, an elastic endless offset blanket 35 consisting of the inner rubber layer 31, the reinforcing layer 32, the compressible rubber layer 33 and the surface rubber layer 34 was withdrawn from the mandrel 41. The resultant blanket 35 was found to be 1.7 mm in thickness, 350 mm in width and 300 mm in inner diameter.

The blanket 35 was cut out in a width of 1 cm, and 5 kg of weight was hung from one end of the cut piece of the blanket 35 with the other end of the blanket 35 fixed. The elongation of the blanket 240 hours later was found to be 2.5%.

The elastic endless offset blanket 35 thus prepared was mounted to the printing apparatus shown in FIG. 8, and printing was performed on a coat board having a thickness of 0.8 mm using an ink of "CARTONSELF" (trade name of an ink for a coated board manufactured by Dai-Nippon Ink & Chemicals, Inc.). After the printing, the printed coated board was cut for preparation of a dressing box. The print quality was found to be markedly superior to that of the conventional flexographic printing. Also, since the printed pattern was continuous, a useless piece was not generated by the cutting, leading to about 7% of paper cost reduction compared with the conventional method. The experiment clearly supports that the printing apparatus of the present invention is far superior to the conventional printing apparatus.

TABLE 1

| components | mixing amount (parts by weight) |
|---|---|
| nitrile rubber (trade name: JSRN 230SH, manufactured by JSR Inc.) | 100 |
| powdery sulfur | 3 |
| stearic acid | 1 |
| zinc oxide | 5 |
| dibenzothiazyl disulfide (trade name, ACCEL DM, manufactured by Kawaguchi Kagaku K.K.) | 2 |
| diphenyl guanidine (trade name, ACCEL D, manufactured by Kawaguchi Kagaku K.K.) | 1 |
| carbon black (trade name, SEAST 3, manufactured by Tokai Carbon K.K.) | 30 |
| white carbon (trade name, CARPLEX 1120, manufactured by Shionogi Inc.) | 20 |
| dioctyl phthalate | 5 |
| total | 167 |

TABLE 2

| components | mixing amount (parts by weight) |
|---|---|
| nitrile rubber (trade name: NIPOLE DN 201, manufactured by Nippon Zeon Inc.) | 100 |
| powdery sulfur | 2 |
| stearic acid | 1 |
| zinc oxide | 5 |
| ACCEL DM | 2 |
| ACCEL D | 1 |
| SEAST 3 | 10 |
| calcium carbonate | 30 |
| DOP | 10 |
| microballoon (trade name, EXPANCEL 091DE, manufactured by Kema Novel Inc.) | 10 |
| total | 171 |

TABLE 3

| components | mixing amount (parts by weight) |
|---|---|
| nitrile rubber (trade name: JSR 230, manufactured by JSR Inc.) | 100 |
| powdery sulfur | 2 |
| stearic acid | 1 |
| zinc oxide | 5 |
| ACCEL DM | 2 |
| ACCEL D | 1 |
| calcium carbonate | 30 |
| CARPLEX 1120 | 20 |
| DOP | 10 |
| blue pigment | 1 |
| total | 172 |

Example 2

A mandrel 41 having a diameter of 300 mm and a width of 350 mm was mounted to a rotating carriage, and a doctor blade 42 was arranged such that the tip portion of the doctor blade 42 was positioned in the vicinity of the outer surface of the mandrel 41, as shown in FIG. 5. Then, a rubber paste prepared by dissolving a compound shown in Table 4 in gasoline was supplied in the clearance between the outer surface of the mandrel 41 and the tip portion of the doctor blade 42. Under this condition, the mandrel 41 was rotated in a direction denoted by an arrow in FIG. 5 to form an inner rubber layer 31 in a thickness of 0.5 mm. The compound shown in Table 4 is an ethylene-propylene rubber having a Shore A hardness of 65° and excellent in wear resistance. Then, a bobbin 44 provided with a moving means and wound with a polyester monofilament string 45 having a thickness of 0.2 mm was arranged in front of the rotating carriage, with one end of the polyester monofilament string 45 fixed to one end of the mandrel 41. The polyester monofilament was dipped in advance with RFL (resorcin formalin latex)-based adhesive for improving the adhesivity to rubber.

The mandrel 41 having the inner rubber layer 31 formed thereon was rotated while moving the bobbin 44 in one direction so as to wind continuously the polyester monofilament string 45 about the mandrel 41 in a manner to form a first reinforcing layer 32 consisting of a string layer. Then, the reinforcing layer 32 was coated with the rubber paste of the composition shown in Table 4 in a thickness of 0.1 mm, followed by rotating the mandrel 41 while moving the bobbin 44 in the opposite direction so as to wind continuously the polyester monofilament string 45 about the mandrel 41 in a manner to form a second reinforcing layer 32' on the first reinforcing layer 32 as shown in FIG. 7B. The diameter of the mandrel 41 including the inner rubber layer 31 and the first and second reinforcing layers 32, 32' was found to be 302 mm.

In the next step, the doctor blade 42 was arranged in the vicinity of the mandrel 41, and a rubber paste prepared by dissolving the compound shown in Table 5 in gasoline was supplied to the clearance between the outer surface of the mandrel 41 and the tip portion of the doctor blade 42. Under this condition, the mandrel 41 was rotated in the direction denoted by the arrow in FIG. 5 so as to form a compressible rubber layer 33 on the second reinforcing layer 32' in a thickness of 0.3 mm. The compound shown in Table 5 contains a foaming agent. When the compound was heated, the foaming agent was decomposed so as to generate a nitrogen gas, thereby forming a porous rubber (sponge). After the compressible rubber layer 33 was sufficiently dried to evaporate the gasoline, the mandrel 41 was detached from the rotating carriage and put in a vulcanizer set at 140° C. so as to carry out a vulcanizing-foaming treatment for 4 hours. After the vulcanizing-foaming treatment, the mandrel was cooled and, then, the surface of the compressible rubber layer 33 was polished with a whetstone until the diameter of the mandrel 41 including the inner rubber layer 31, the first and second reinforcing layers 32, 32' and the compressible rubber layer 33 was decreased to 302.6 mm.

Further, rubber of the composition shown in Table 6 was sufficiently mixed with a mixing roll and, then, formed into a sheet having a thickness of 0.5 mm by a calender machine. The resultant sheet was wound in a single ply about the surface of the compressible rubber layer 33 to form a surface rubber layer 34, followed by applying a heat treatment to the surface rubber layer 34 in a vulcanizer set at 130° C. for 3 hours.

After the vulcanizing treatment, the surface rubber layer 34 was cooled and, then, polished with a whetstone and sand paper to reduce the diameter of mandrel 41 including the inner rubber layer 31, the first and second reinforcing layer 32, 32', the compressible rubber layer 33 and the surface rubber layer 34 to 303.4 mm. Also, the surface roughness Rz of the surface rubber layer 34 after the polishing treatment was found to be 4 to 6 $\mu$m. Finally, an elastic endless offset blanket 35 consisting of the inner rubber layer 31, the first and second reinforcing layer 32, 32', the compressible rubber layer 33 and the surface rubber layer 34 was withdrawn from the mandrel 41. The resultant blanket 35 was found to be 1.7 mm in thickness, 350 mm in width and 300 mm in inner diameter.

A peripheral portion of the blanket 35 was cut in a circumferential direction in a width of 1 cm, and 5 kg of weight was hung from the cut piece of the blanket 35 with one end of the cut piece of the blanket 35 fixed. The elongation of the blanket 240 hours later was found to be 1.5%.

The elastic endless offset blanket 35 thus prepared was mounted to the printing apparatus shown in FIG. 8, and printing was performed on an embossed wall paper using an ink of "DIE CURE DG-4" (trade name of a water-free UV ink manufactured by Dai-Nippon Ink & Chemicals, Inc.). The wall paper having a resin processing applied to the surface thereof exhibits a good wettability with the UV ink and, thus, is adapted for the printing. After the printing, the printed wall paper was irradiated with a light emitted from an UV lamp. The ink was instantly cured, leading to a high printing speed and, thus, to an improved productivity. Further, since the elastic endless offset blanket used was rich in compressibility, the ink permeated deep into the concave portion of the embossed wall paper so as to markedly improve the quality of the printed image.

TABLE 4

| components | mixing amount (parts by weight) |
|---|---|
| ethylene-propylene rubber (trade name: ESPRENE505, manufactured by Sumitomo Kagaku K.K.) | 100 |
| powdery sulfur | 1.5 |
| stearic acid | 1 |
| zinc oxide | 5 |

TABLE 4-continued

| components | mixing amount (parts by weight) |
|---|---|
| ACCELERATOR TS (tetramethyl thiuram monosulfide | 2 |
| ACCELERATOR M | 0.5 |
| HAF carbon | 50 |
| naphthene-based process oil | 20 |
| total | 170.9 |

TABLE 5

| components | mixing amount (parts by weight) |
|---|---|
| ethylene-propylene rubber (trade name: MITSUI EP4045, manufactured by Mitsui Petrochemical Co., Ltd.) | 100 |
| powdery sulfur | 1.5 |
| stearic acid | 1 |
| zinc oxide | 5 |
| ACCELERATOR PZ (zinc dimethyl dithio carbamate) | 1.5 |
| ACCELERATOR M | 1 |
| calcium carbonate | 10 |
| HAF carbon | 20 |
| naphthene-based process oil | 10 |
| foaming agent (NEOCELBON P · 1000N, benzene sulfonyl hydrazide) | 10 |
| total | 160 |

TABLE 6

| components | mixing amount (parts by weight) |
|---|---|
| ethylene-propylene rubber (trade name: MITSUI EPT4070, manufactured by Mitsui Petrochemical Co., Ltd.) | 100 |
| powdery sulfur | 1.5 |
| stearic acid | 1 |
| zinc oxide | 5 |
| ACCELERATOR TS | 1.5 |
| ACCELERATOR M | 0.5 |
| calcium carbonate | 30 |
| CARPLEX 1120 | 20 |
| naphthene-based process oil | 10 |
| insulating pigment | 1 |
| total | 160 |

Example 3

A mandrel 41 having a diameter of 300 mm and a width of 350 mm was mounted to a rotating carriage, and a doctor blade 42 was arranged such that the tip portion of the doctor blade 42 was positioned in the vicinity of the outer surface of the mandrel 41, as shown in FIG. 5. Then, a de-acetone type paste prepared by adding 7 parts by weight of conductive carbon and carbon black (trade name, KETCHEN BLACK EC, manufactured by Mitsubishi Chemical Co., Ltd. Japan) to a one-component type silicone rubber (trade name, KE3493, manufactured by Shin-etsu Chemical Co., Ltd. Japan) was supplied in the clearance between the outer surface of the mandrel 41 and the tip portion of the doctor blade 42. Under this condition, the mandrel 41 was rotated in the direction denoted by the arrow in FIG. 5 to form an inner rubber layer 31 in a thickness of 0.5 mm. Then, a bobbin 44 provided with a moving means and wound with an Aramid fiber string 45 having a thickness of 0.2 mm was arranged in front of the rotating carriage, with one end of the Aramid fiber string 45 fixed to one end of the mandrel 41. The Aramid fiber was treated in advance with an epoxy silane coupling agent (trade name, KBM303, manufactured by Shin-etsu Chemical Co., Ltd., Japan).

The mandrel 41 having the inner rubber layer 31 formed thereon was rotated while moving the bobbin 44 in one direction so as to wind continuously the Aramid fiber string 45 about the mandrel 41 in a manner to form a reinforcing layer 32 consisting of the string layer. Then, the reinforcing layer 32 was coated with a paste prepared by adding 7 parts by weight of Ketchen Black EC and 10 parts by weight of "MATSUMOTO MICRO-SPHERE F-50 (trade name of vinylidene chloride-series microballoons manufactured by Matumoto Fat and Oil Pharmaceutical Inc. Japan) to the one-component type silicone rubber KE3493 so as to form a rubber layer on the reinforcing layer 32 in a thickness of 0.5 mm. The rubber layer was left to stand at room temperature for 24 hours so as to complete the curing, followed by leaving the rubber layer to stand in an oven set at 110° C. for 2 hours. As a result, the microballoons having a softening point of 100° C. were expanded within the rubber layer 33 to form a compressible rubber layer 33 having innumerable fine cells.

Then, the outer surface of the compressible rubber layer 33 was polished with a whetstone to decrease the diameter of the mandrel 41 including the inner rubber layer 31, the reinforcing layer 32 and the compressible rubber layer 33 to 302.6 mm. Since the conductive carbon black was contained in each of the inner rubber layer 31 and the compressible rubber layer 33, these rubber layers formed semi-conductive rubber layers having an electrical resistance of $10^6$ to $10^8\Omega$.

Further, a surface rubber layer 34 was formed by coating the surface of the compressible rubber layer 33 with a paste prepared by adding 10% of a catalyst "Ca-RP" manufactured by Shin-etsu Chemical Co., Ltd. Japan, to a two-component type silicone rubber "KE1092" (condensation type) manufactured by Shin-etsu Chemical Co., Ltd., Japan in a thickness of 0.5 mm, followed by leaving the surface rubber layer 34 to stand for 24 hours so as to complete the curing. Then, the surface of the surface rubber layer 34 was polished with a whetstone and sand paper to decrease the diameter of mandrel 41 including the inner rubber layer 31, the reinforcing layer 32, the compressible rubber layer 33 and the surface rubber layer 34 to 303.4 mm. Also, the surface roughness Rz of the surface rubber layer 34 after the polishing treatment was found to be 1 to 2 $\mu$m. Finally, an elastic endless offset blanket 35 consisting of the inner rubber layer 31, the reinforcing layer 32 consisting of the Aramid fiber, the compressible rubber layer 33 and the surface rubber layer 34 was withdrawn from the mandrel 41. The resultant endless blanket 35 was found to be 1.7 mm in thickness, 350 mm in width and 300 mm in inner diameter.

A peripheral portion of the blanket 35 was cut out in a width of 1 cm, and 5 kg of weight was hung from the cut piece of the blanket 35 with one end of the cut piece of the blanket 35 fixed. The elongation of the blanket 240 hours later was found to be 0.2%.

Finally, the plate cylinder was detached from the printing apparatus and a photosensitive drum was mounted to the printing apparatus. Further, the elastic endless offset blanket 35 was mounted to the printing apparatus as an electrical developing means in place of an inking apparatus. Under this condition, printing was performed on a coated paper sheet using an aqueous toner. Since the toner was highly peelable from the silicone rubber, substantially 100% of the toner was transferred onto the coated paper sheet so as to obtain a high quality wrapping paper excellent in luster.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A printing apparatus comprising a driving roll, a supporting roll, an elastic endless offset blanket stretched between the driving roll and the supporting roll, a plurality of plate cylinders for transferring inks having a plurality of different colors onto the elastic endless offset blanket, a plurality of first impression drums arranged to have the endless offset blanket held between the first impression drums and the plate cylinders, ink supply means for supplying the inks of the plural colors to the plate cylinders, and a second impression drum positioned to push the supporting roll and to have a printing medium held between the supporting roll and the second impression drum, the inks of the plural colors transferred onto the elastic endless offset blanket being printed on the printing medium in a single operation, wherein said endless offset blanket comprises a reinforcing layer consisting of a single string layer or a plurality of string layers, a compressible rubber layer formed on the reinforcing layer, and an ink-resisting surface rubber layer formed on the compressible rubber layer.

2. The printing apparatus according to claim 1, wherein said elastic endless offset blanket has an elongation of at most 5% under a tension of 5 kgf/cm.

3. The printing apparatus according to claim 1, wherein said reinforcing layer is formed of two string layers consisting of a first string layer prepared by winding a string about a cylindrical member from one end of the cylindrical member to reach the other end of the cylindrical member and a second string layer formed on said first string layer by winding the string about the first string layer from said other end of the cylindrical member to reach said one end of the cylindrical member, said string being wound such that adjacent turns of each of said first and second string layers are in mutual contact.

4. The printing apparatus according to claim 1, wherein said string used for forming the reinforcing layer is selected from the group consisting of natural fibers, synthetic fibers, inorganic fibers, and carbon fiber.

5. The printing apparatus according to claim 1, wherein the material of the compressible rubber layer and the surface rubber layer is selected from the group consisting of acrylonitrile rubber, butadiene rubber, hydrogenated nitrile rubber, chloroprene rubber, silicone rubber, fluorosilicone rubber, epichlorohydrin rubber, natural rubber, butyl rubber, fluororubber, ethylene-propylene rubber, isoprene rubber, urethane rubber, styrene-butadiene rubber, and a mixture thereof.

6. The printing apparatus according to claim 4, wherein the natural fiber is selected from the group consisting of cotton fiber, hemp fiber, silk fiber and rayon fiber.

7. The printing apparatus according to claim 4, wherein the synthetic fiber is selected from the group consisting of polyester fiber, nylon fiber, polyamide fiber, polyimide fiber, Aramid fiber and polyacrylate fiber.

8. The printing apparatus according to claim 4, wherein the inorganic fiber is selected from the group consisting of glass fiber, boron fiber, tyrano fiber, alumina fiber, steel fiber and ceramic fiber.

* * * * *